US010185266B2

(12) United States Patent
Hirota

(10) Patent No.: US 10,185,266 B2
(45) Date of Patent: Jan. 22, 2019

(54) IMAGE FORMING APPARATUS FOR REDUCING MISDETECTIONS

(71) Applicant: CANON KABUSHIKI KAISHA, Tokyo (JP)

(72) Inventor: Shingo Hirota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/709,120

(22) Filed: Sep. 19, 2017

(65) Prior Publication Data

US 2018/0081312 A1 Mar. 22, 2018

(30) Foreign Application Priority Data

Sep. 21, 2016 (JP) ..... 2016-184722

(51) Int. Cl.

*G03G 15/00* (2006.01)
*G03G 15/20* (2006.01)
*G03G 21/20* (2006.01)

(52) U.S. Cl.

CPC ..... *G03G 15/5037* (2013.01); *G03G 15/80* (2013.01); *G03G 15/2053* (2013.01); *G03G 21/20* (2013.01); *G03G 2215/00632* (2013.01)

(58) Field of Classification Search

CPC ..... G03G 15/5037
See application file for complete search history.

(56) References Cited

U.S. PATENT DOCUMENTS 5,485,248 A * 1/1996 Yano ..... G03G 15/0216 399/168
2003/0053809 A1* 3/2003 Ogata ..... G03G 15/553 399/12
2007/0166066 A1* 7/2007 Kitano ..... G03G 15/0266 399/50
2008/0118257 A1* 5/2008 Murakami ..... G03G 15/553 399/49
2011/0274448 A1* 11/2011 Yamashita ..... G03G 15/0216 399/31

FOREIGN PATENT DOCUMENTS

JP 5-223513 A 8/1993
JP 2007-171462 A 7/2007
JP 2013-156537 A 8/2013

* cited by examiner

*Primary Examiner* — Victor Verbitsky
(74) *Attorney, Agent, or Firm* — Canon U.S.A., Inc. IP Division

(57) ABSTRACT

After a predetermined period elapses since the start of use of a photosensitive member, if a calculated value calculated from a detection current between a charging unit and a photosensitive member is out of a predetermined range, a determining unit does not perform determination using a currently calculated value and, if the calculated value is within the predetermined range, the determining unit performs determination using the currently calculated value.

8 Claims, 9 Drawing Sheets

IMAGE FORMING APPARATUS FOR REDUCING MISDETECTIONS

BACKGROUND

Field of the Disclosure

The present disclosure, relates to an image forming apparatus which employs an electrophotographic process or an electrostatic recording process, such as a copier and a laser printer.

Description of the Related Art

As an electrophotographic photosensitive member (hereinafter, referred to as "photosensitive member"), a photosensitive member in which a photosensitive layer (an organic photosensitive layer) using an organic material as a photoconductive substance (a charge generation material and a charge transport material) is provided on a metal substrate is widely used for its low cost and high productivity. As a photosensitive member, a photosensitive member which includes a laminated photosensitive layer in which a charge generation layer containing a charge generation material of a photoconductive dye or a photoconductive pigment, and a charge transport layer containing a charge transport material of a photoconductive polymer or a photoconductive low-molecular compound are laminated is mainly used.

Since electrical external force and/or mechanical external force are directly applied to a surface of the photosensitive member during charging, exposure, development, transfer, and cleaning, the photosensitive member needs durability to withstand these external forces. In particular, the photosensitive member needs durability with respect to a flaw and wear of the surface caused by these external forces, that is, scratch resistance and abrasion resistance. Examples of photosensitive members with improved scratch resistance and abrasion resistance on a surface thereof include a photosensitive member with a surface layer which is a cured layer made of curable resin as binding resin, a photosensitive member with a surface layer which is a charge transport cured layer formed by curing polymerization of a monomer having a carbon-carbon double bond and a charge transport monomer having a carbon-carbon double bond with heat or light energy, and a photosensitive member with a surface layer which is a charge transport cured layer formed by curing polymerization of a hole transport compound having a chain polymerizable functional group in the same molecule with electron beam energy. As described above, in order to improve scratch resistance and abrasion resistance of the circumferential surface of the photosensitive member, a technology of forming the surface layer of the photosensitive member by a cured layer and thereby increasing mechanical strength of the surface layer has been established recently.

However, even in a photosensitive member having a cured layer as a surface layer, surface wear cannot be avoided completely. After a prolonged period of use, the cured layer is abraded. Then, the photosensitive layer disposed below the cured layer will be exposed and wear the photosensitive layer will start. The photosensitive layer is susceptible to mechanical external force and is suddenly worn out from the exposed portion. As the wear of the photosensitive layer which is an insulating material proceeds, charge will move to the metal substrate disposed below the photosensitive layer in the worn portion. Then, the charge cannot be maintained and the photosensitive layer reaches the end of service life. In that case, if life estimating has been performed, a service engineer or the like who replaces the photosensitive member can easily know accurate replacement timing.

As an example technology of performing life estimating, Japanese Patent Laid-Open No. 5-223513 describes detecting a film thickness of a photosensitive member by applying a voltage to a charging unit and detecting a direct current which flows through the photosensitive member.

However, it has turned out that a direct current which flows through a photosensitive member is affected by exposure memory of the photosensitive member. The exposure memory occurs when the photosensitive member is exposed to light other than a latent image means, such as a fluorescent lamp light. In the photosensitive member in which the exposure memory occurs, charge generated during exposure is trapped in the charge generation layer. If a voltage is applied to the photosensitive member by the charging unit in this state, besides the usually generated direct current, a direct current caused by flowing of the trapped charge is also generated. As a result, in the photosensitive member in which exposure memory occurs, an extra direct current will be detected and, therefore, misdetection of the film thickness will occur.

SUMMARY

The present disclosure reduces misdetection of residual service life of a photosensitive member caused by exposure memory.

An aspect of an embodiment is to provide an image forming apparatus, including: a photosensitive member; a charging unit configured to come into contact with the photosensitive member and charge the photosensitive member; an exposure unit configured to form an electrostatic latent image on a surface of the photosensitive member charged by the charging unit; a development unit configured to develop the electrostatic latent image formed on the photosensitive member; a power source configured to apply at least a direct current voltage to the charging unit during a charging operation; a current detection unit configured to detect a current of a direct current component which flows between the photosensitive member and the charging unit; and a determining unit configured to determine whether the photosensitive member is to be replaced based on a calculated value calculated using a detection result detected by the current detection unit, wherein, if the calculated value is out of a predetermined range, the determining unit does not perform determination using a currently calculated value and, if the calculated value is in the predetermined range, the determining unit performs determination using the currently calculated value.

Further features of the present disclosure will become apparent from the following description of exemplary embodiments with reference to the attached drawings.

DESCRIPTION OF THE EMBODIMENTS

Hereinafter, embodiments of the present disclosure will be described with reference to the drawings, in which like numerals denote like configurations and operations, which are not described repeatedly.

Image Forming Apparatus

Figure 1:
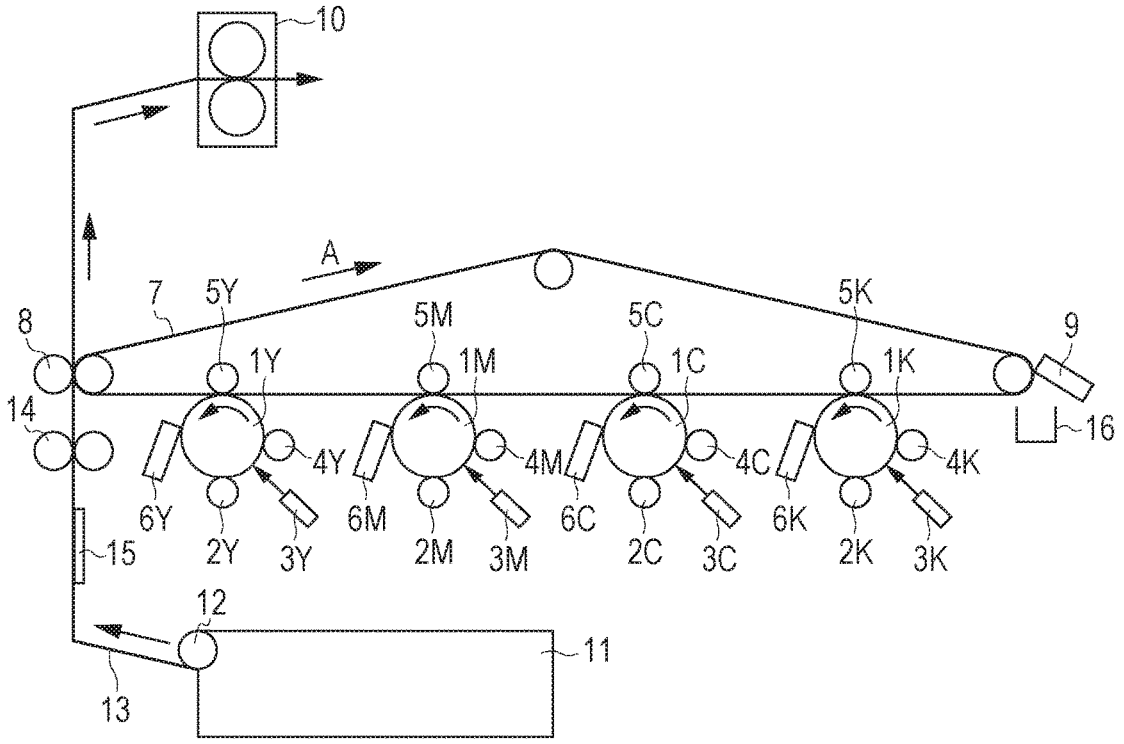
FIG. 1 is a schematic configuration diagram of an image forming apparatus according to the present disclosure.

FIG. 1 illustrates a schematic configuration of an image forming apparatus of the present embodiment. The image forming apparatus of the present embodiment is a laser printer of an electrophotographic process which employs a contact charging system. First, an entire configuration of the image forming apparatus of the present embodiment will be described with reference to FIG. 1.

Photoconductor Drum

Figure 2:
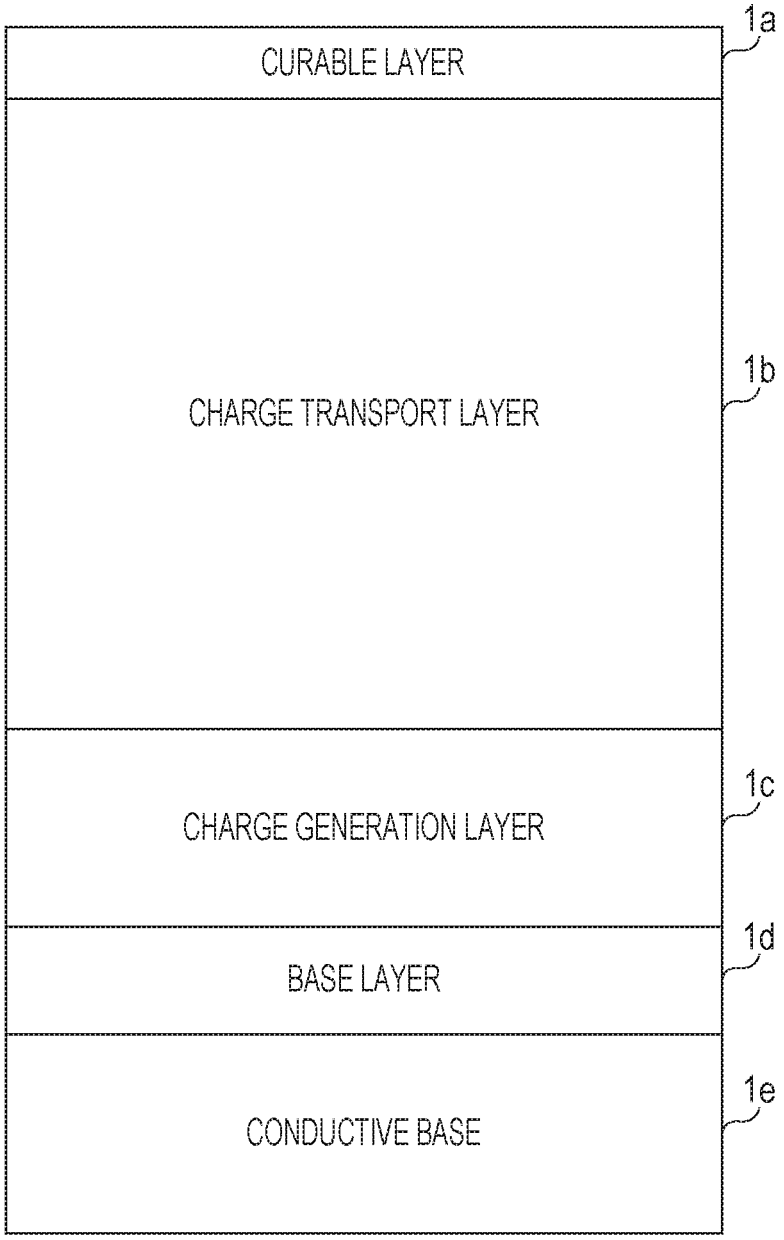
FIG. 2 illustrates a layer structure of a photosensitive member according to the present disclosure.

FIG. 2 illustrates a layer structure of the photosensitive member 1 in the present embodiment. The photosensitive member 1 is a rotating drum-shaped organic electrophotographic photosensitive member which is charged negatively. In the photosensitive member 1, on a surface of an aluminum cylinder (a conductive drum base), a charge generation layer made of an organic material, and a charge transport layer (thickness: about 20 μm) are formed by coating in this order from the bottom. A surface layer of the photosensitive member 1 is a cured layer formed by using curable resin as binding resin. Although the cured layer formed by using curable resin is used in a surface curing process of the photosensitive member 1 in the present embodiment, this is not restrictive. For example, a charge transport cured layer formed by curing polymerization of a monomer having a carbon-carbon double bond and a charge transport monomer having a carbon-carbon double bond with heat or light energy, and a charge transport cured layer formed by curing polymerization of a hole transport compound having a chain polymerizable functional group in the same molecular with electron beam energy. In the present embodiment, the photosensitive member 1 is 340 mm in length in an axial direction and 30 mm in an outer diameter. The photosensitive member 1 is driven to rotate in a direction of a curved arrow at a process speed (a circumferential speed) of 200 mm/sec about a central supporting axis.

Charging Roller

A charging unit 2 is a charging roller 2*a* as a contacting charging unit which comes into contact with a surface of the photosensitive member 1 and uniformly charges the surface of the photosensitive member 1. The charging roller 2*a* is 330 mm in length in the axial direction and 14 mm in diameter, and is formed by providing a conductive rubber layer around a stainless steel core metal. The charging roller 2*a* is rotatably held by bearing members at both ends of the core metal, urged toward the photosensitive member 1 by a pressing spring, and pressed against the surface of the photosensitive member 1 with predetermined pressing force. Therefore, the charging roller 2*a* follows to rotation of the photosensitive member 1 and is rotated at a circumferential speed of 300 mm/sec. The charging roller 2*a* is charged using a discharge phenomenon generated in a fine gap between the charging roller 2*a* and the photosensitive member 1. A charging voltage of a predetermined condition is applied to the core metal of the charging roller 2*a* from a power source unit PS1. In the present embodiment, the power source unit PS1 is constituted by a DC power source and an AC power source. For example, during the charging operation, when a direct current voltage to be applied is set to −500V, and an alternating current voltage is set to a peak-to-peak voltage of 1.8 kV which is more than double the value of a discharge starting voltage in the environment, an image forming unit of the rotating photosensitive member 1 is uniformly charged to about −500V. The direct current voltage applied during image formation is not limited to this value, and may be suitably set to a potential suitable for desirable image formation depending on an environment, a use durable status of the photosensitive member 1 and the charging roller 2*a*, for example.

Laser Scanner

An exposure unit 3 includes an exposure apparatus as an information writing unit for forming an electrostatic latent image on the charged surface of the photosensitive member 1. In the present embodiment, the exposure apparatus is a laser scanner which uses a semiconductor laser. The laser scanner outputs laser light which is modulated in accordance with image signals sent to a printer from a host processor, such as an image scanner, and performs laser-scanning exposure of the uniformly charged surface of the rotating photosensitive member 1. With the laser-scanning exposure, the potential of the surface of the photosensitive member 1 in an area irradiated with the laser light decreases, and an electrostatic latent image corresponding to the image information is sequentially formed on the surface of the rotating photosensitive member 1.

Developing Apparatus

A development unit 4 is a developing apparatus which supplies toner in accordance with the electrostatic latent image on the photosensitive member 1, and performs reversal development of the electrostatic latent image into a toner image. A developing sleeve 4*a* which is a developer carrying member of the developing apparatus is 325 mm in length in the axial direction. In the present embodiment, the developing sleeve 4*a* holds a magnetic brush by a two-component developer constituted by toner and a carrier, and performs development with the magnetic brush being in contact with the photosensitive member 1. In the present embodiment, toner which is obtained by kneading pigment into a resin binder constituting mainly of polyester, and then crushing and classifying is used. An average particle diameter of the toner is about 6 μm. An average charge amount of the toner adhering to the photosensitive member 1 is about −30 μCg. A predetermined developing voltage is applied to the developing apparatus from a power source unit PS2. In the present embodiment, the predetermined developing voltage is an oscillating voltage in which a direct current voltage (Vdc) and an alternating current voltage (Vac) are superimposed. For example, the oscillating voltage has a frequency of 8.0 kHz, and in which a peak-to-peak voltage of 1.8 kV and a rectangular alternating current voltage are superimposed. The direct current voltage is suitably set to become an appropriate fog removal voltage with respect to a potential of the photosensitive member 1 in the development unit.

Primary Transfer Roller

A primarily transfer member 5 is a primary transfer roller 5*a* in the present embodiment. The primary transfer roller 5*a* is pressed in a direction to pinch an intermediate transfer member 7 with the photosensitive member 1 with predetermined pressing force, and a pressure contact nip portion is a primary transfer portion. A transfer voltage of which polarity (positive) is opposite to that of the regular charging polarity (negative) of the toner (in the present embodiment, +600V) is applied to the primary transfer roller 5*a* from a power source unit PS3. Then, the toner images on the surfaces of the photosensitive members 1 are sequentially transferred to a surface of the intermediate transfer member 7. From the intermediate transfer member 7 to which the toner images are transferred through the primary transfer portion, the toner images are transferred to a recording material 15 fed at predetermined control timing from a mechanism unit in a secondary transfer portion 8. In the present embodiment, the secondary transfer portion 8 is a secondary transfer roller 8*a*, and the transfer voltage of +800V is applied to the secondary transfer roller 8*a*. The recording material 15 is conveyed to a fixing unit 10. In the present embodiment, the fixing unit 10 is a heat roller fixing device, and the recording material 15 is subjected to a fixing process of the toner image by the fixing unit 10 and output as an image-formed matter (a print, a copy).

Drum Cleaner

A cleaning unit 6 removes transfer residual toner slightly remaining on the surface of the photosensitive member 1 after the transfer of the toner images to the intermediate transfer member 7 in the primary transfer portion 5. The cleaning unit 6 in the present embodiment is plate-shaped and made of urethane rubber, and is 330 mm in length in the axial direction. A cleaning blade 6*a* is pressed against the photosensitive member 1 with linear pressure of 30 gf/cm.

In the present embodiment, the photosensitive member 1, the charging roller 2, and the cleaning blade are integrated in a drum cartridge (the image formation unit).

Control Circuit

The image forming apparatus of the present disclosure includes a control circuit 100 which is a control unit, and may perform various types of control. The control circuit 100 is constituted by a CPU 120, RAM 121, and ROM 122. The RAM 121 and the ROM 122 may be memory within a base in the image forming apparatus or memory in a tag provided in the drum cartridge. The control circuit 100 stores a temperature and a humidity inside and outside of the image forming apparatus detected by an environmental sensor, and feeds them back to image formation.

Current Detection Circuit

Figure 3:
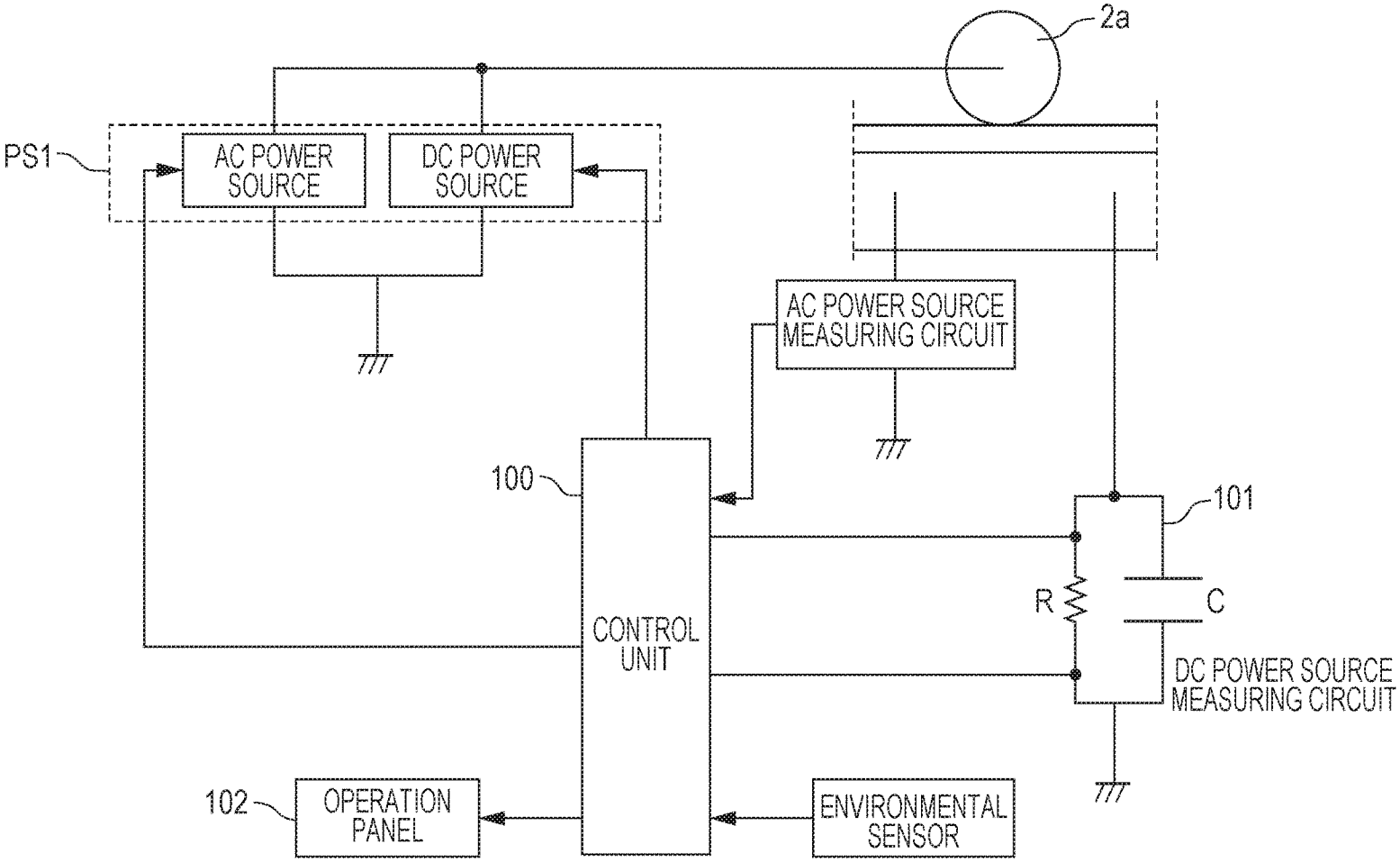
FIG. 3 is a control block diagram of a high voltage applied to a charging unit in the present disclosure.

FIG. 3 is a control block diagram of a high voltage applied to the charging unit 2 in the present embodiment. As illustrated in FIG. 3, a current detection circuit 101 which is a current detection unit is provided between the photosensitive member 1 and a ground potential. The current detection circuit 101 includes a resistance R for measuring a direct current I which is a current of a DC component flowing into the photosensitive member 1 from the charging roller 2*a* by the direct current voltage of the oscillating voltage, and a capacitor C for bypassing an alternating current flowing into the photosensitive member 1 by the alternating current voltage. The current detection circuit 101 has an existing configuration for monitoring a direct current and an alternating current generated by an oscillating voltage applied to the charging roller 2*a* in the control circuit 100. This existing configuration is used also as film thickness measurement of a photosensitive layer of the photosensitive member 1. The control circuit 100 measures an inter-terminal voltage of the resistance R, and calculates a film thickness of the photosensitive layer of the photosensitive member 1, or value corresponding to a film thickness of the photosensitive layer of the photosensitive member 1 based on the measurement value.

First Embodiment

Regarding a process speed of the photosensitive member 1 during direct current detection in the present embodiment, a method of changing from a process speed during of ordinary image formation will be described.

First, detection of a film thickness of the photosensitive member 1 in the present disclosure will be described.

Mechanism of Detection of Film Thickness of Photoconductor 1

Figure 4:
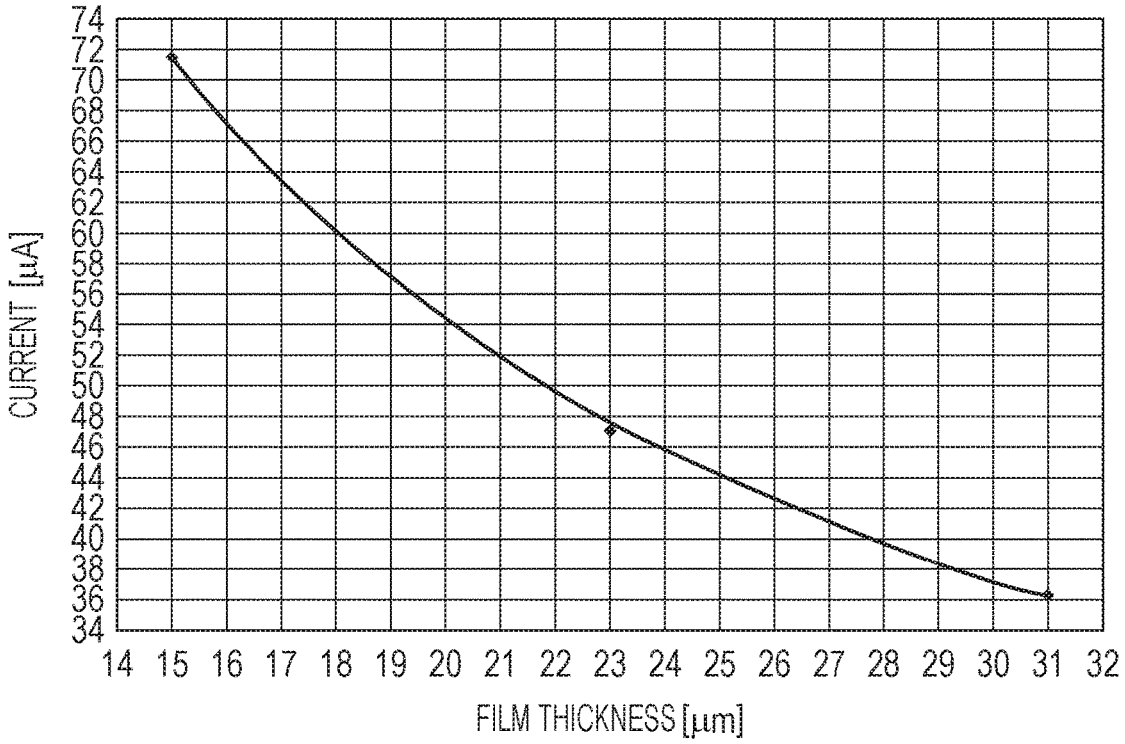
FIG. 4 illustrates a relationship between a film thickness of the photosensitive member and a current upon application of a predetermined voltage in the present disclosure.

FIG. 4 illustrates a relationship between the film thickness of the photosensitive member 1 and the direct current I which flows when a direct current voltage is applied to the photosensitive member 1 from the charging roller 2*a*. A relationship expressed by Expression 1 is established between a surface potential V0 of the photosensitive member 1 provided by the charging roller 2*a* and a film thickness d of the photosensitive layer of the photosensitive member 1. The film thickness d is a distance from the surface of the photosensitive layer to a surface of a conductive base 1*e*. In Expression 1, Q defines an amount of charge per unit area provided to the photosensitive layer, C defines electrostatic capacity per unit area of the photosensitive layer, ε0 defines permittivity in vacuum, and εr defines a specific dielectric constant of the photosensitive layer.

$$Q=CV0=\varepsilon 0\cdot\varepsilon r\cdot 1/d\cdot V0 \qquad \text{Expression 1}$$

As Expression 1 indicates, as the photosensitive member 1 is worn to reduce the film thickness d of the photosensitive layer, the charge Q increases when the same surface potential V0 is applied. That is, in order to measure the film thickness d of the photosensitive member 1, it is only needed to measure the charge Q (the direct current value I).

The residual service life of the photosensitive member 1 can be estimated from the thus obtained film thickness of the photosensitive layer of the photosensitive member 1. In order to more precisely estimate the residual service life, a difference ΔI between the measured direct current value I and an initial direct current value I0 is used. This is a method of estimating the residual service life from the viewpoint that to what extent is the photosensitive member 1 abraded with respect to a determined film thickness. In the present embodiment, a value obtained by dividing ΔI by ΔI0 (an abrasion amount when an image defect occurs in the photosensitive member 1 is expressed as a direct current value) is referred to as an LF value (a calculated value) (unit: %) and the value is used for the life estimating of the photosensitive member 1. In the present embodiment, when the LF value reaches 90%, replacement of the drum cartridges is encouraged on the display unit of the image forming apparatus. In the present embodiment, an initial direct current value desirably is a value with no exposure memory existing. In particular, the value desirably is a value measured when the use of the drum cartridge enclosed with an image forming apparatus at the time of installation of the image forming apparatus is started. Alternatively, when the drum cartridge is attached, a predetermined value may be input.

Direct Current Detection

Figure 5A:
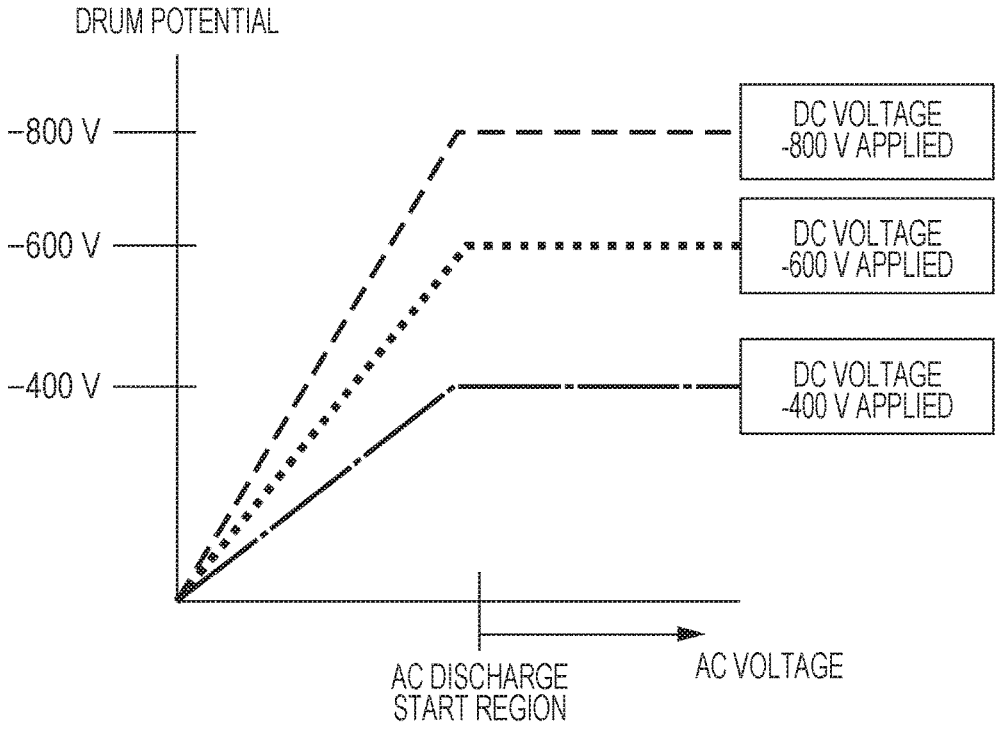
FIGS. 5A and 5B are correlation charts of an alternating current voltage and a direct current in the present disclosure.
Figure 5B:
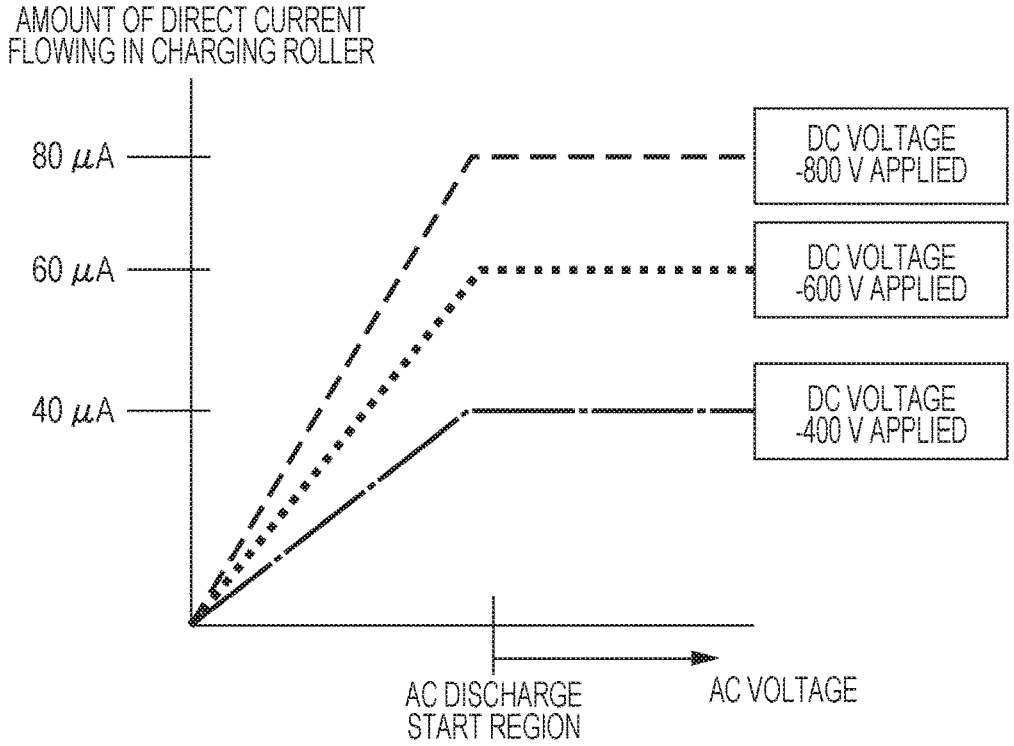

In the present disclosure, direct current detection is performed in order to detect the film thickness of the photosensitive member 1. The direct current detection is performed when the current detection circuit 101 detects a direct current value while the charging roller 2*a* is applying a high oscillating voltage to the photosensitive member 1. In the present disclosure, when the control circuit 100 detects a predetermined number of supplied sheets, controls the charging roller 2*a* to apply a high oscillating voltage which is different from a voltage used in usual image formation, and controls the current detection circuit 101 to detect a direct current. In the present embodiment, the direct current voltage of the charging roller 2*a* is −700V, and the alternating current voltage is the same as that in image formation. In the present embodiment, an absolute value of the direct current voltage during direct current detection is set to be larger than an absolute value of the direct current voltage during image formation. FIGS. 5A and 5B are correlation charts of an alternating current voltage superimposed on a direct current voltage and a direct current value I detected in the direct current detection. As illustrated in FIG. 5A, if the alternating current voltage is not enough, the direct current voltage applied to the charging roller 2*a* cannot fully be reflected on a charged potential (a drum potential) of the photosensitive member 1. As illustrated in FIG. 5B, if the alternating current voltage is not enough, a relationship between the direct current value I flowing through the charging roller 2*a* and measured and the direct current voltage becomes unstable. Therefore, the alternating current voltage under the same conditions as those in the image formation is used in the present embodiment.

Influence on LF Value by Exposure Memory

Next, an influence on the LF value by the exposure memory will be described.

When a high voltage is applied to the photosensitive member 1 by the charging roller 2*a*, a molecular chain on the surface layer of the photosensitive member 1 is destroyed and the surface layer is weakened. The weakened surface layer of the photosensitive member 1 is abraded by the cleaning blade 6*a*. The film thickness of the photosensitive member 1 on which image formation including the above process is repeatedly performed is reduced, and a change in the detected current value is detected by the direct current detection. However, the reduction of the film thickness of the photosensitive member 1 by the image formation takes time, and a prolonged period of image formation is needed in order to make a difference in the direct current detection. In the present embodiment, in order to make a difference in the direct current detection, an interval of film thickness detection is set to each 1000 supplied sheets. The interval of film thickness detection is not limited to the number of supplied sheets, however, may be charge application time which is a time period in which the photosensitive member 1 is exposed to a high voltage applied by the charging roller 2*a*, a charge travel distance in which the photosensitive member 1 is driven while being exposed to a high voltage, or every set time from previous detection timing.

Figure 8:
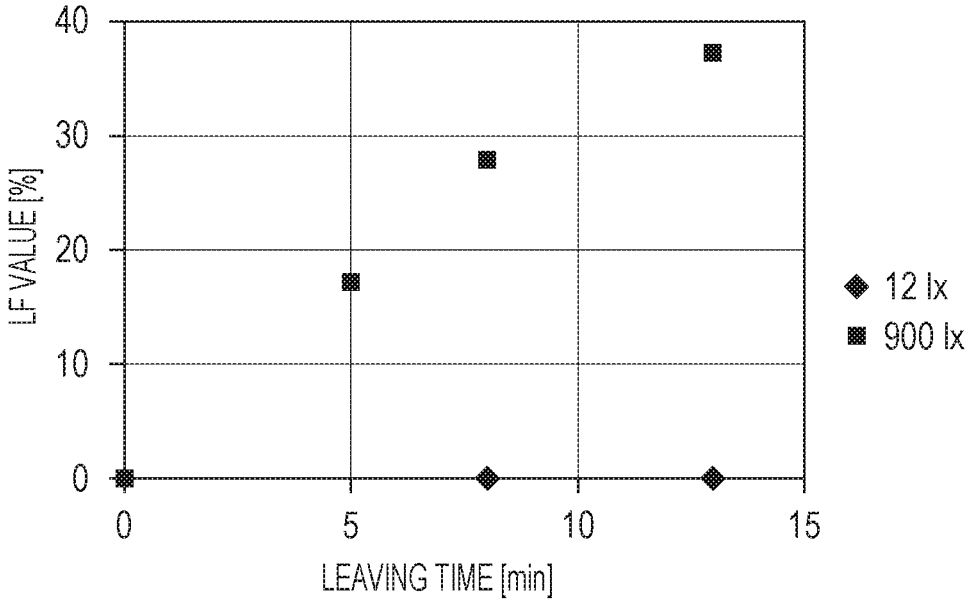
FIG. 8 is a relationship diagram of exposure time of the photosensitive member and an LF value while changing an exposure light quantity according to the present disclosure.
Figure 9:
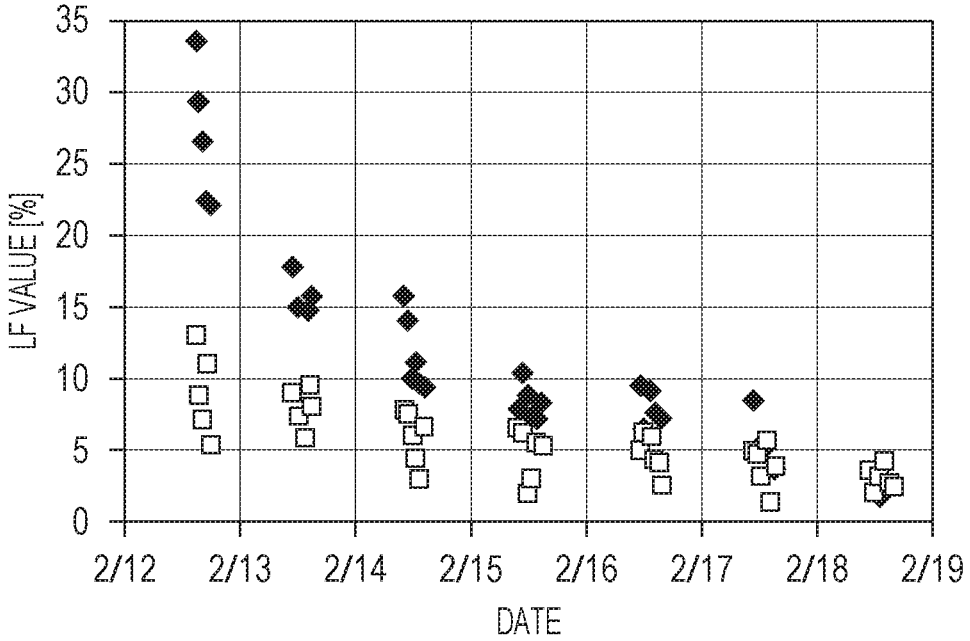
FIG. 9 is a relationship diagram of leaving time of the photosensitive member in which exposure memory occurs and an LF value according to the present disclosure.

A change in the direct current caused by the exposure memory occurs in a short time. FIG. 8 is a relationship diagram of exposure time of the photosensitive member 1 and the LF value while changing an exposure light quantity. An increase in the LF value is proportional to the light quantity and the exposure time. In the light of 900 lx intended for a common office environment, the LF value increases about 20% by the exposure for 5 minutes. This increase corresponds to an increase when 40000 sheets are supplied in usual image formation, which indicates that the influence of the exposure memory occurs in a short time. The LF value increased by the exposure memory returns to its original value in about one week irrespective of the increased amount. FIG. 9 is a relationship diagram of leaving time of the photosensitive member 1 in which exposure memory occurs and the LF value. Since the influence of the exposure memory does not continue for a long period of time, misdetection of the LF value caused by the exposure memory occurs only when a service engineer performs maintenance at user's place.

Detection of Exposure Memory

Next, determination of presence or absence of the exposure memory of the photosensitive member 1 in the present embodiment will be described.

The control circuit 100 (a determining unit) of the present embodiment has a function to determine residual service life of the photosensitive member 1 based on the calculated value calculated using the detected current value detected by the current detection unit. In particular, after performing the direct current detection, the control circuit 100 calculates an amount of change ΔLF value L which is a difference between an LF value obtained in the previous direct current detection and an LF value obtained in the current direct current detection. Next, the control circuit 100 calculates an upper limit value L0 of the ΔLF value from a charge travel distance from the previous direct current detection to the current direct current detection, and information about temperature and humidity obtained by an environmental sensor. The upper limit value L0 is an estimated value (a setting value) calculated from a progress state from the previous direct current detection to the current direct current detection. In the present embodiment, the abrasion amount of the photosensitive member 1 estimated from an arbitrary charge travel distance is set to a maximum value of the ΔLF value. When the ΔLF value L is in a predetermined range not exceeding the upper limit value L0, the control circuit 100 determines that the abraded state of the photosensitive member 1 is a state that may occur usually, and sets to a direct current detection mode in which the LF value obtained by the direct current detection is displayed as it is. If the ΔLF value L is out of the predetermined range, i.e., if the ΔLF value L is the upper limit value L0 or greater, that is, if the ΔLF value L is equal to or greater than a setting value, such as L0, the control circuit 100 determines that an increase in the LF value is caused by the exposure memory. Then, the control circuit 100 sets to a charge travel distance mode in which a value obtained by adding the upper limit value L0 to the previous LF value is displayed instead of using the LF value obtained by the direct current detection.

Flowchart

Figure 6:
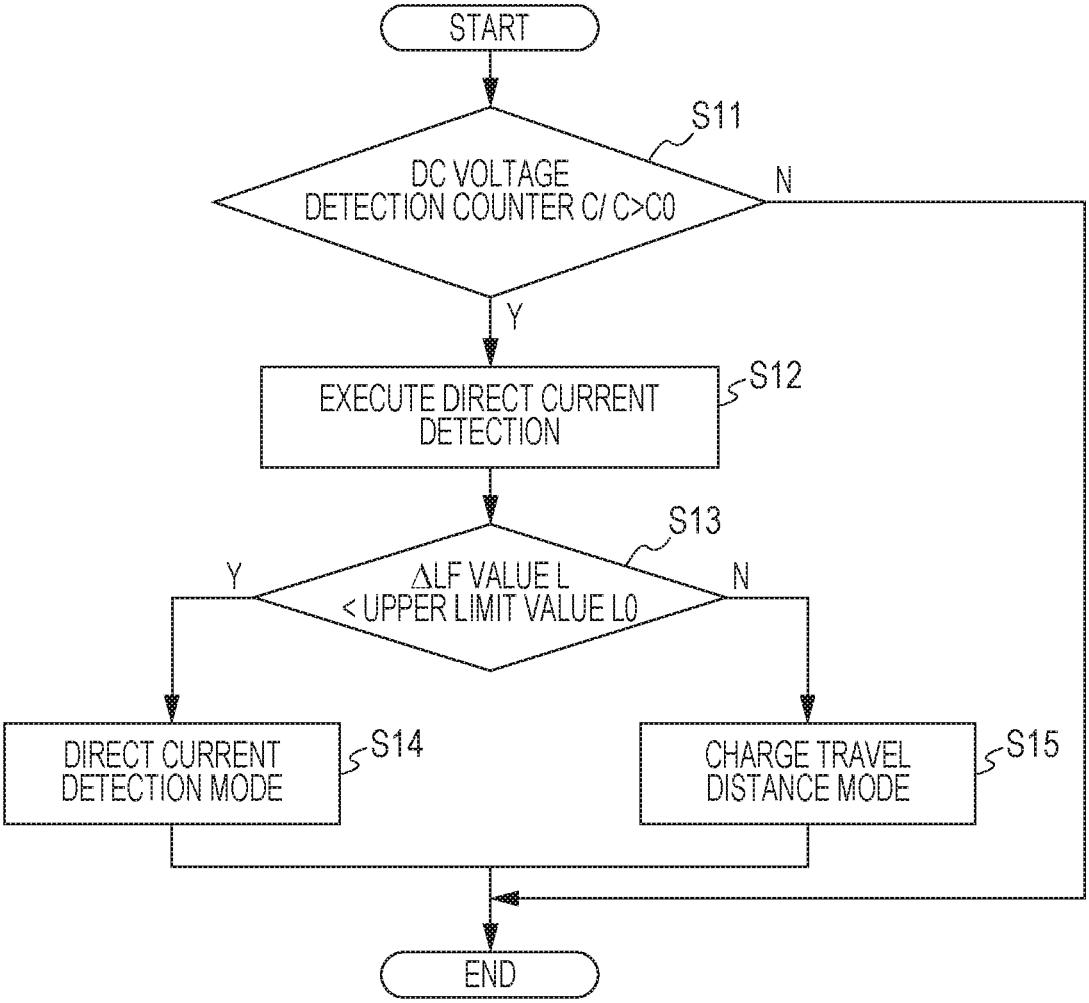
FIG. 6 is a flowchart in a first embodiment of the present disclosure.

FIG. 6 illustrates a flowchart of the direct current detection in the first embodiment. First, the control circuit 100 determines whether a direct current detection control counter C exceeds an execution threshold C0 (S11). In the present embodiment, a counter which indicates the number of formed images performs the control of the present embodiment for each predetermined value. If the counter C does not exceed the execution threshold C0 (S11: No), the control circuit 100 completes the control. If the counter C is equal to or greater than the execution threshold C0 (S11: Yes), the control circuit 100 continues the control. The control circuit 100 performs direct current detection control (S12). The control circuit 100 calculates the LF value of the photosensitive member 1 from the direct current value detected by the current detection circuit 101, and determines whether the ΔLF value L which is a difference of the LF value exceeds the upper limit value L0 (S13). Then the control circuit 100 determines whether the mode is a direct current detection mode or a charge travel distance mode. If the ΔLF value L is in the predetermined range not exceeding the upper limit value L0 (S13: Yes), the control circuit 100 displays the LF value and determination results, such as a determination result of the residual service life, and a result in the direct current detection mode (S14), and then the control circuit 100 completes the control. Here, in the direct current detection mode, a display indicating that a value calculated using a detected current value has been employed is displayed. If the ΔLF value L is out of the predetermined range exceeding the upper limit value L0 (S13: No), the control circuit 100 displays the LF value and determination results, such as a determination result of the residual service life and a result in the charge travel distance mode (S15), and then the control circuit 100 completes the control. Here, in the charge travel distance mode, a display indicating that the LF value is calculated from an estimated abrasion amount of the photosensitive member is displayed.

As described above, according to the present embodiment, by detecting the state of the exposure memory on the photosensitive member 1, misdetection of the film thickness of the photosensitive member 1 caused by the exposure memory can be avoided, and the residual service life of the photosensitive member 1 can be estimated accurately.

Second Embodiment

The present embodiment is a configuration with respect to exposure memory of a photosensitive member 1 which is highly likely to occur when a photosensitive member is replaced or a drum cartridge is replaced. By referring to the use history of the photosensitive member 1, it is possible to automatically change to a charge travel distance mode. That is, when the photosensitive member (or the drum cartridge) is replaced, the charge travel distance mode is automatically employed instead of employing the direct current detection mode in a predetermined period from the replacement and start of use of the photosensitive member. The control unit 100 detects attachment and removal of the photosensitive member to and from an image forming apparatus. Examples of the detection methods may include a method of providing memory in the drum cartridge and detecting attachment and removal by contact with the image forming apparatus, and a method of providing sensor for detecting attachment and removal in the image forming apparatus. That is, in this predetermined period, a configuration in which no current detection is performed or even if current detection is performed, the result is not used for life estimating. After a predetermined period elapses, the control circuit 100 determines whether the mode is a direct current detection mode or a charge travel distance mode. Here, the predetermined period may be a period until a counter which counts the number of formed images of the photosensitive member 1 reaches a predetermined number, a period until charging application time which is a time period in which the photosensitive member 1 is exposed to a high voltage applied by a charging roller 2*a* reaches a predetermined time, a period until a charge travel distance which is a distance in which the photosensitive member 1 is driven while being exposed to a high voltage reaches a predetermined distance, or a period until predetermined time elapses from previous replacement. In the present embodiment, the predetermined period is a period until a counter which counts the number of formed images reaches a predetermined number.

Flowchart

Figure 7:
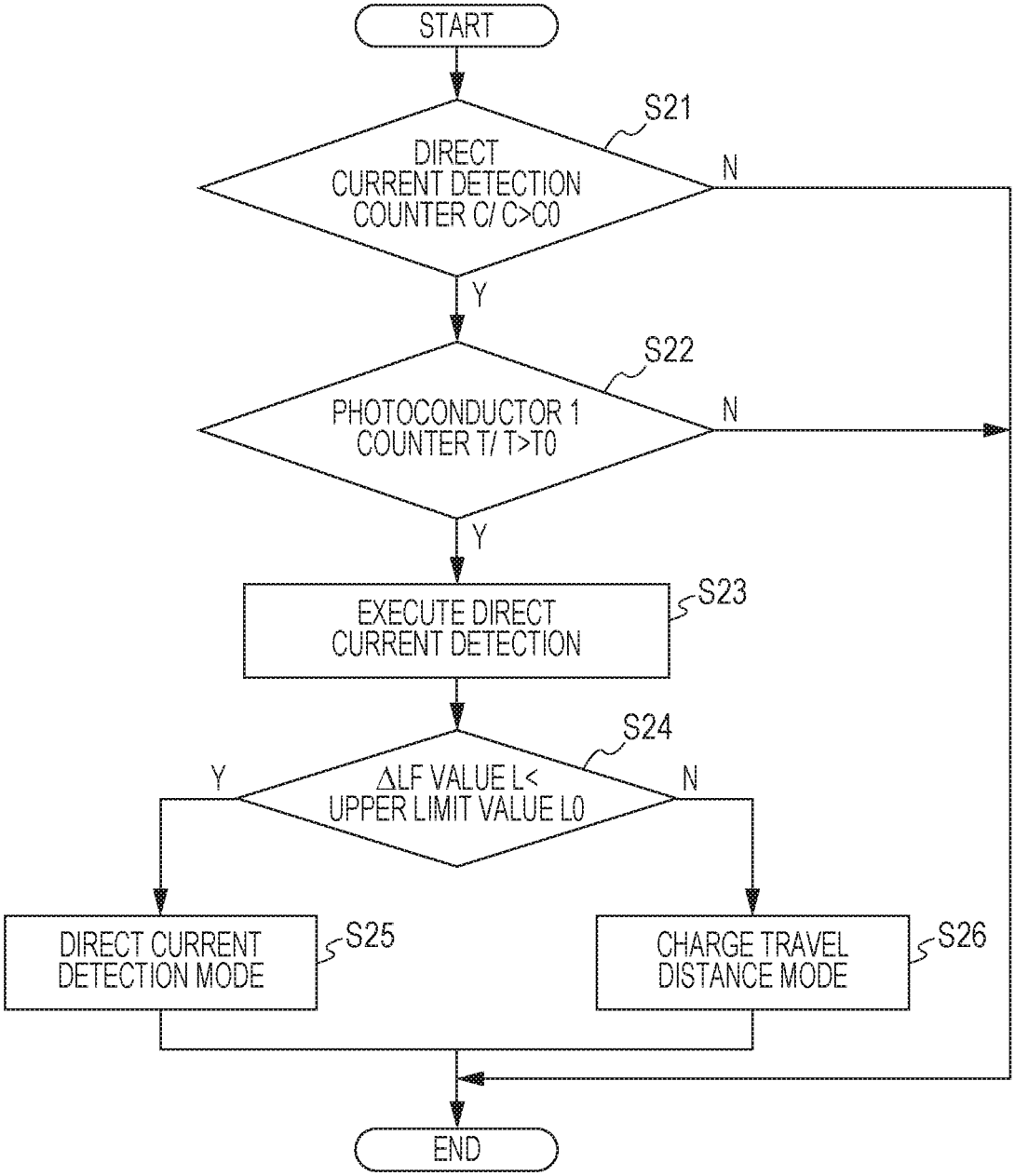
FIG. 7 is a flowchart in a second embodiment of the present disclosure.

FIG. 7 illustrates a flowchart of direct current detection in the second embodiment. First, the control circuit 100 determines whether a direct current detection control counter C exceeds an execution threshold C0 (S21). In the present embodiment, direct current detection control is performed for each predetermined number of formed images. If the counter C does not exceed the execution threshold C0 (S21: No), the control circuit 100 completes the control. If the counter C is equal to or greater than the execution threshold C0 (S21: Yes), the control circuit 100 continues the control. The control circuit 100 determines whether a photosensitive member counter T exceeds an execution threshold T0 (S22). The photosensitive member counter T counts the number of formed images after the photosensitive member (or the drum cartridge) is replaced. In the present embodiment, the execution threshold T0 is set to 1000 sheets. If the photosensitive member counter T does not exceed the execution threshold T0 (S22: No), the control circuit 100 completes the control. If the photosensitive member counter T is equal to or greater than the execution threshold T0 (S22: Yes), the control circuit 100 continues the control. The control circuit 100 performs direct current detection control (S23). The control circuit 100 calculates an LF value of the photosensitive member 1 from a direct current detected by a current detection circuit 101, and determines whether a ΔLF value L which is a difference of the LF value exceeds an upper limit value L0 (S24). If the ΔLF value L does not exceed the upper limit value L0 (S24: Yes), the control circuit 100 displays the LF value, a determination result of the residual service life, and a result in the direct current detection mode (S25), and then the control circuit 100 completes the control. If the ΔLF value L exceeds the upper limit value L0 (S24: No), the control circuit 100 displays the LF value, a determination result of the residual service life, and a result in the charge travel distance mode (S26), and then the control circuit 100 completes the control.

According to the present embodiment, even if exposure memory is caused in the photosensitive member by replacement of the photosensitive member, accuracy in determination of residual service life (replacement timing) can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-184722, filed Sep. 21, 2016, which is hereby incorporated by reference herein in entirety.

What is claimed is:

1. An image forming apparatus, comprising:

a photosensitive member;

a charging unit configured to come into contact with the photosensitive member and charge the photosensitive member;

an exposure unit configured to form an electrostatic latent image on a surface of the photosensitive member charged by the charging unit;

a development unit configured to develop the electrostatic latent image formed on the photosensitive member;

a power source configured to apply at least a direct current voltage to the charging unit during a charging operation;

a current detection unit configured to detect a current of a direct current component which flows between the photosensitive member and the charging unit; and a determining unit configured to determine whether the photosensitive member is to be replaced based on a calculated value calculated using a detection result detected by the current detection unit, wherein, if an amount of change between a currently calculated value and a previously calculated value is equal to or larger than a setting value, the determining unit perform determination using a value obtained by adding the setting value to the previously calculated value, and if the amount of change is smaller than the setting value, the determining unit performs determination using the currently calculated value.

2. The image forming apparatus according to claim 1, further comprising a display unit configured to display information about the photosensitive member in accordance with a determination result of the determining unit.

3. The image forming apparatus according to claim 1, wherein the calculated value is calculated using a value of current detected by the current detection unit when a direct current voltage is applied of which an absolute value is greater than an absolute value of a direct current voltage applied to the charging unit during image formation.

4. The image forming apparatus according to claim 1, wherein the determining unit does not determine whether the photosensitive member is to be replaced until a predetermined period elapses after the photosensitive member is attached.

5. The image forming apparatus according to claim 4, further comprising:

a control unit configured to detect that the photosensitive member is attached.

6. The image forming apparatus according to claim 4, wherein, a cartridge which includes the photosensitive member and the charging unit enables attachment of the photosensitive member and the charging unit to the image forming apparatus in an integrated manner.

7. The image forming apparatus according to claim 4, wherein the predetermined period is a period until the number of formed images reaches a predetermined value after the photosensitive member is attached.

8. The image forming apparatus according to claim 4, wherein the predetermined period is a period until a predetermined time elapses after the photosensitive member is attached.

* * * * *